US010516930B2

(12) United States Patent
Martin et al.

(10) Patent No.: US 10,516,930 B2
(45) Date of Patent: Dec. 24, 2019

(54) COMPARATIVE ANALYSIS OF SENSORS TO CONTROL POWER STATUS FOR WIRELESS EARPIECES

(71) Applicant: BRAGI GmbH, München (DE)

(72) Inventors: Toby Martin, München (DE); Eric Christian Hirsch, München (DE); Volker Klein, München (DE); Christian Begusch, München (DE); Matthias Lackus, München (DE); Arne D. Loermann, München (DE); Nikolaj Hviid, München (DE)

(73) Assignee: BRAGI GmbH, München (DE)

( * ) Notice: Subject to any disclaimer, the term of this patent is extended or adjusted under 35 U.S.C. 154(b) by 0 days.

(21) Appl. No.: 15/643,187

(22) Filed: Jul. 6, 2017

(65) Prior Publication Data

US 2018/0014103 A1 Jan. 11, 2018

Related U.S. Application Data

(60) Provisional application No. 62/359,316, filed on Jul. 7, 2016.

(51) Int. Cl.
*H04R 1/10* (2006.01)

(52) U.S. Cl.
CPC ..... *H04R 1/1025* (2013.01); *H04R 1/1041* (2013.01); *H04R 2420/07* (2013.01); *H04R 2460/03* (2013.01)

(58) Field of Classification Search
USPC ..... 381/17, 26, 74, 362, 367, 370, 311, 7, 381/151, 328, 330
See application file for complete search history.

(56) References Cited

U.S. PATENT DOCUMENTS 2,325,590 A 8/1943 Carlisle et al.
2,430,229 A 11/1947 Kelsey
(Continued)

FOREIGN PATENT DOCUMENTS

CN 204244472 U 4/2015
CN 104683519 A 6/2015
(Continued)

OTHER PUBLICATIONS

Akkermans, "Acoustic Ear Recognition for Person Identification", Automatic Identification Advanced Technologies, 2005 pp. 219-223.

(Continued)

*Primary Examiner* — Yosef K Laekemariam
(74) *Attorney, Agent, or Firm* — Goodhue, Coleman & Owens, P.C.

(57) ABSTRACT

A system, method, and wireless earpieces for managing power settings. Sensor measurements are performed utilizing a first sensor array of the wireless earpieces to detect light and motion. Sensor measurements are performed utilizing a second sensor array of the wireless earpieces to detect light and motion. The sensor measurements are analyzed from the first sensor array and the second sensor array. A determination is made whether a change event is detected in response to the sensor measurements. The change event is confirmed as detected. The wireless earpieces enter a full power mode in response to the change event being confirmed.

19 Claims, 5 Drawing Sheets

(56) References Cited

U.S. PATENT DOCUMENTS 3,047,089 A 7/1962 Zwislocki
D208,784 S 10/1967 Sanzone
3,586,794 A 6/1971 Michaelis
3,934,100 A 1/1976 Harada
3,983,336 A 9/1976 Malek et al.
4,069,400 A 1/1978 Johanson et al.
4,150,262 A 4/1979 Ono
4,334,315 A 6/1982 Ono et al.
D266,271 S 9/1982 Johanson et al.
4,375,016 A 2/1983 Harada
4,588,867 A 5/1986 Konomi
4,617,429 A 10/1986 Bellafiore
4,654,883 A 3/1987 Iwata
4,682,180 A 7/1987 Gans
4,791,673 A 12/1988 Schreiber
4,852,177 A 7/1989 Ambrose
4,865,044 A 9/1989 Wallace et al.
4,984,277 A 1/1991 Bisgaard et al.
5,008,943 A 4/1991 Arndt et al.
5,185,802 A 2/1993 Stanton
5,191,602 A 3/1993 Regen et al.
5,201,007 A 4/1993 Ward et al.
5,201,008 A 4/1993 Arndt et al.
D340,286 S 10/1993 Seo
5,280,524 A 1/1994 Norris
5,295,193 A 3/1994 Ono
5,298,692 A 3/1994 Ikeda et al.
5,343,532 A 8/1994 Shugart
5,347,584 A 9/1994 Narisawa
5,363,444 A 11/1994 Norris
D367,113 S 2/1996 Weeks
5,497,339 A 3/1996 Bernard
5,606,621 A 2/1997 Reiter et al.
5,613,222 A 3/1997 Guenther
5,654,530 A 8/1997 Sauer et al.
5,692,059 A 11/1997 Kruger
5,721,783 A 2/1998 Anderson
5,748,743 A 5/1998 Weeks
5,749,072 A 5/1998 Mazurkiewicz et al.
5,771,438 A 6/1998 Palermo et al.
D397,796 S 9/1998 Yabe et al.
5,802,167 A 9/1998 Hong
D410,008 S 5/1999 Almqvist
5,929,774 A 7/1999 Charlton
5,933,506 A 8/1999 Aoki et al.
5,949,896 A 9/1999 Nageno et al.
5,987,146 A 11/1999 Pluvinage et al.
6,021,207 A 2/2000 Puthuff et al.
6,054,989 A 4/2000 Robertson et al.
6,081,724 A 6/2000 Wilson
6,084,526 A 7/2000 Blotky et al.
6,094,492 A 7/2000 Boesen
6,111,569 A 8/2000 Brusky et al.
6,112,103 A 8/2000 Puthuff
6,157,727 A 12/2000 Rueda
6,167,039 A 12/2000 Karlsson et al.
6,181,801 B1 1/2001 Puthuff et al.
6,208,372 B1 3/2001 Barraclough
6,230,029 B1 5/2001 Yegiazaryan et al.
D455,835 S 7/2001 Znutas
6,275,789 B1 8/2001 Moser et al.
6,339,754 B1 1/2002 Flanagan et al.
6,408,081 B1 6/2002 Boesen
6,424,820 B1 7/2002 Burdick et al.
D464,039 S 10/2002 Boesen
6,470,893 B1 10/2002 Boesen
D468,299 S 1/2003 Boesen
D468,300 S 1/2003 Boesen
6,542,721 B2 4/2003 Boesen
6,560,468 B1 5/2003 Boesen
6,654,721 B2 11/2003 Handelman
6,664,713 B2 12/2003 Boesen
6,690,807 B1 2/2004 Meyer
6,694,180 B1 2/2004 Boesen
6,718,043 B1 4/2004 Boesen
6,738,485 B1 5/2004 Boesen
6,748,095 B1 6/2004 Goss
6,754,358 B1 6/2004 Boesen et al.
6,784,873 B1 8/2004 Boesen et al.
6,823,195 B1 11/2004 Boesen
6,852,084 B1 2/2005 Boesen
6,879,698 B2 4/2005 Boesen
6,892,082 B2 5/2005 Boesen
6,920,229 B2 7/2005 Boesen
6,952,483 B2 10/2005 Boesen et al.
6,987,986 B2 1/2006 Boesen
7,010,137 B1 3/2006 Leedom et al.
7,113,611 B2 9/2006 Leedom et al.
D532,520 S 11/2006 Kampmeier et al.
7,136,282 B1 11/2006 Rebeske
7,203,331 B2 4/2007 Boesen
7,209,569 B2 4/2007 Boesen
7,215,790 B2 5/2007 Boesen et al.
D549,222 S 8/2007 Huang
D554,756 S 11/2007 Sjursen et al.
7,403,629 B1 7/2008 Aceti et al.
D579,006 S 10/2008 Kim et al.
7,463,902 B2 12/2008 Boesen
7,508,411 B2 3/2009 Boesen
D601,134 S 9/2009 Elabidi et al.
7,689,378 B2 * 3/2010 Kolen ..... G01C 17/00 702/150
7,825,626 B2 11/2010 Kozisek
7,945,297 B2 5/2011 Philipp
7,965,855 B1 6/2011 Ham
7,979,035 B2 7/2011 Griffin et al.
7,983,628 B2 7/2011 Boesen
D647,491 S 10/2011 Chen et al.
8,095,188 B2 1/2012 Shi
8,108,143 B1 1/2012 Tester
8,140,357 B1 3/2012 Boesen
D666,581 S 9/2012 Perez
8,300,864 B2 10/2012 Müllenborn et al.
8,406,448 B2 3/2013 Lin
8,436,780 B2 5/2013 Schantz et al.
D687,021 S 7/2013 Yuen
8,719,877 B2 5/2014 VonDoenhoff et al.
8,774,434 B2 7/2014 Zhao et al.
8,831,266 B1 9/2014 Huang
8,891,800 B1 11/2014 Shaffer
8,994,498 B2 3/2015 Agrafioti et al.
D728,107 S 4/2015 Martin et al.
9,013,145 B2 4/2015 Castillo et al.
9,037,125 B1 5/2015 Kadous
D733,103 S 6/2015 Jeong et al.
9,081,944 B2 7/2015 Camacho et al.
9,510,159 B1 11/2016 Cuddihy et al.
D773,439 S 12/2016 Walker
D775,158 S 12/2016 Dong et al.
D777,710 S 1/2017 Palmborg et al.
D788,079 S 5/2017 Son et al.
2001/0005197 A1 6/2001 Mishra et al.
2001/0027121 A1 10/2001 Boesen
2001/0043707 A1 11/2001 Leedom
2001/0056350 A1 12/2001 Calderone et al.
2002/0002413 A1 1/2002 Tokue
2002/0007510 A1 1/2002 Mann
2002/0010590 A1 1/2002 Lee
2002/0030637 A1 3/2002 Mann
2002/0046035 A1 4/2002 Kitahara et al.
2002/0057810 A1 5/2002 Boesen
2002/0076073 A1 6/2002 Taenzer et al.
2002/0118852 A1 8/2002 Boesen
2003/0002705 A1 1/2003 Boesen
2003/0065504 A1 4/2003 Kraemer et al.
2003/0100331 A1 5/2003 Dress et al.
2003/0104806 A1 6/2003 Ruef et al.
2003/0115068 A1 6/2003 Boesen
2003/0125096 A1 7/2003 Boesen
2003/0218064 A1 11/2003 Conner et al.
2004/0070564 A1 4/2004 Dawson et al.
2004/0160511 A1 8/2004 Boesen
2005/0017842 A1 1/2005 Dematteo
2005/0043056 A1 2/2005 Boesen

(56) References Cited

U.S. PATENT DOCUMENTS

| | | | |
|---|---|---|---|
| 2005/0094839 | A1 | 5/2005 | Gwee |
| 2005/0125320 | A1 | 6/2005 | Boesen |
| 2005/0148883 | A1 | 7/2005 | Boesen |
| 2005/0165663 | A1 | 7/2005 | Razumov |
| 2005/0196009 | A1 | 9/2005 | Boesen |
| 2005/0251455 | A1 | 11/2005 | Boesen |
| 2005/0266876 | A1 | 12/2005 | Boesen |
| 2006/0029246 | A1 | 2/2006 | Boesen |
| 2006/0074671 | A1 | 4/2006 | Farmaner et al. |
| 2006/0074808 | A1 | 4/2006 | Boesen |
| 2006/0166715 | A1 | 7/2006 | Engelen et al. |
| 2006/0166716 | A1 | 7/2006 | Seshadri et al. |
| 2006/0220915 | A1 | 10/2006 | Bauer |
| 2006/0258412 | A1 | 11/2006 | Liu |
| 2008/0076972 | A1 | 3/2008 | Dorogusker et al. |
| 2008/0090622 | A1 | 4/2008 | Kim et al. |
| 2008/0146890 | A1 | 6/2008 | LeBoeuf et al. |
| 2008/0254780 | A1 | 10/2008 | Kuhl et al. |
| 2008/0255430 | A1 | 10/2008 | Alexandersson et al. |
| 2009/0003620 | A1 | 1/2009 | McKillop et al. |
| 2009/0008275 | A1 | 1/2009 | Ferrari et al. |
| 2009/0017881 | A1 | 1/2009 | Madrigal |
| 2009/0073070 | A1 | 3/2009 | Rofougaran |
| 2009/0097689 | A1 | 4/2009 | Prest et al. |
| 2009/0105548 | A1 | 4/2009 | Bart |
| 2009/0131124 | A1* | 5/2009 | Bibaud ..... H04M 1/6066 455/575.2 |
| 2009/0191920 | A1 | 7/2009 | Regen et al. |
| 2009/0245559 | A1 | 10/2009 | Boltyenkov et al. |
| 2009/0261114 | A1 | 10/2009 | McGuire et al. |
| 2009/0296968 | A1 | 12/2009 | Wu et al. |
| 2010/0033313 | A1 | 2/2010 | Keady et al. |
| 2010/0203831 | A1 | 8/2010 | Muth |
| 2010/0210212 | A1 | 8/2010 | Sato |
| 2010/0320961 | A1 | 12/2010 | Castillo et al. |
| 2011/0140844 | A1 | 6/2011 | McGuire et al. |
| 2011/0239497 | A1 | 10/2011 | McGuire et al. |
| 2011/0286615 | A1 | 11/2011 | Olodort et al. |
| 2012/0057740 | A1 | 3/2012 | Rosal |
| 2013/0316642 | A1 | 11/2013 | Newham |
| 2013/0346168 | A1 | 12/2013 | Zhou et al. |
| 2014/0079257 | A1 | 3/2014 | Ruwe et al. |
| 2014/0106677 | A1 | 4/2014 | Altman |
| 2014/0122116 | A1 | 5/2014 | Smythe |
| 2014/0163771 | A1 | 6/2014 | Demeniuk |
| 2014/0185828 | A1 | 7/2014 | Helbling |
| 2014/0222462 | A1 | 8/2014 | Shakil et al. |
| 2014/0235169 | A1 | 8/2014 | Parkinson et al. |
| 2014/0270227 | A1 | 9/2014 | Swanson |
| 2014/0270271 | A1 | 9/2014 | Dehe et al. |
| 2014/0348367 | A1 | 11/2014 | Vavrus et al. |
| 2015/0028996 | A1 | 1/2015 | Agrafioti et al. |
| 2015/0110587 | A1 | 4/2015 | Hori |
| 2015/0148989 | A1 | 5/2015 | Cooper et al. |
| 2015/0245127 | A1 | 8/2015 | Shaffer |
| 2016/0033280 | A1 | 2/2016 | Moore et al. |
| 2016/0072558 | A1 | 3/2016 | Hirsch et al. |
| 2016/0073189 | A1 | 3/2016 | Lindén et al. |
| 2016/0125892 | A1 | 5/2016 | Bowen et al. |
| 2016/0166203 | A1* | 6/2016 | Goldstein ..... A61B 5/6817 600/301 |
| 2016/0360350 | A1 | 12/2016 | Watson et al. |
| 2017/0064437 | A1 | 3/2017 | Hviid et al. |
| 2017/0078780 | A1 | 3/2017 | Qian et al. |
| 2017/0111726 | A1 | 4/2017 | Martin et al. |
| 2017/0155992 | A1 | 6/2017 | Perianu et al. |

FOREIGN PATENT DOCUMENTS

| | | | |
|---|---|---|---|
| CN | 104837094 | A | 8/2015 |
| EP | 1469659 | A1 | 10/2004 |
| EP | 1017252 | A3 | 5/2006 |
| EP | 2903186 | A1 | 8/2015 |
| GB | 2074817 | | 4/1981 |
| GB | 2508226 | A | 5/2014 |
| WO | 2008103925 | A1 | 8/2008 |
| WO | 2007034371 | A3 | 11/2008 |
| WO | 2011001433 | A2 | 1/2011 |
| WO | 2012071127 | A1 | 5/2012 |
| WO | 2013134956 | A1 | 9/2013 |
| WO | 2014046602 | A1 | 3/2014 |
| WO | 2014043179 | A3 | 7/2014 |
| WO | 2015061633 | A2 | 4/2015 |
| WO | 2015110577 | A1 | 7/2015 |
| WO | 2015110587 | A1 | 7/2015 |
| WO | 2016032990 | A1 | 3/2016 |

OTHER PUBLICATIONS

Announcing the $3,333,333 Stretch Goal (Feb. 24, 2014).

Ben Coxworth: "Graphene-based ink could enable low-cost, foldable electronics", "Journal of Physical Chemistry Letters", Northwestern University, (May 22, 2013).

Blain: "World's first graphene speaker already superior to Sennheiser MX400", htt://www.gizmag.com/graphene-speaker-beats-sennheiser-mx400/31660, (Apr. 15, 2014).

BMW, "BMW introduces BMW Connected—The personalized digital assistant", "http://bmwblog.com/2016/01/05/bmw-introduces-bmw-connected-the-personalized-digital-assistant", (Jan. 5, 2016).

BRAGI is on Facebook (2014).

BRAGI Update—Arrival of Prototype Chassis Parts—More People—Awesomeness (May 13, 2014).

BRAGI Update—Chinese New Year, Design Verification, Charging Case, More People, Timeline(Mar. 16, 2015).

BRAGI Update—First Sleeves From Prototype Tool—Software Development Kit (Jun. 5, 2014).

BRAGI Update—Let's Get Ready to Rumble, A Lot to Be Done Over Christmas (Dec. 22, 2014).

BRAGI Update—Memories From April—Update on Progress (Sep. 16, 2014).

BRAGI Update—Memories from May—Update on Progress—Sweet (Oct. 13, 2014).

BRAGI Update—Memories From One Month Before Kickstarter—Update on Progress (Jul. 10, 2014).

BRAGI Update—Memories From the First Month of Kickstarter—Update on Progress (Aug. 1, 2014).

BRAGI Update—Memories From the Second Month of Kickstarter—Update on Progress (Aug. 22, 2014).

BRAGI Update—New People ©BRAGI—Prototypes (Jun. 26, 2014).

BRAGI Update—Office Tour, Tour to China, Tour to CES (Dec. 11, 2014).

BRAGI Update—Status on Wireless, Bits and Pieces, Testing-Oh Yeah, Timeline(Apr. 24, 2015).

BRAGI Update—The App Preview, The Charger, The SDK, BRAGI Funding and Chinese New Year (Feb. 11, 2015).

BRAGI Update—What We Did Over Christmas, Las Vegas & CES (Jan. 19, 2014).

BRAGI Update—Years of Development, Moments of Utter Joy and Finishing What We Started(Jun. 5, 2015).

BRAGI Update—Alpha 5 and Back to China, Backer Day, on Track(May 16, 2015).

BRAGI Update—Beta2 Production and Factory Line(Aug. 20, 2015).

BRAGI Update—Certifications, Production, Ramping Up.

BRAGI Update—Developer Units Shipping and Status(Oct. 5, 2015).

BRAGI Update—Developer Units Started Shipping and Status (Oct. 19, 2015).

BRAGI Update—Developer Units, Investment, Story and Status(Nov. 2, 2015).

BRAGI Update—Getting Close(Aug. 16, 2015).

BRAGI Update—On Track, Design Verification, How It Works and What's Next(Jul. 15, 2015).

BRAGI Update—On Track, on Track and Gems Overview.

BRAGI Update—Status on Wireless, Supply, Timeline and Open House@BRAGI(Apr. 1, 2015).

(56) References Cited

OTHER PUBLICATIONS

BRAGI Update—Unpacking Video, Reviews on Audio Perform and Boy Are We Getting Close(Sep. 10, 2015).
Healthcare Risk Management Review, "Nuance updates computer-assisted physician documentation solution" (Oct. 20, 2016).
Hoyt et. al., "Lessons Learned from Implementation of Voice Recognition for Documentation in the Military Electronic Health Record System", The American Health Information Management Association (2017).
Hyundai Motor America, "Hyundai Motor Company Introduces a Health + Mobility Concept for Wellness in Mobility", Fountain Valley, Californa (2017).
International Search Report & Written Opinion, PCT/EP2016/070231 (dated Nov. 18, 2016).
Last Push Before the Kickstarter Campaign Ends on Monday 4pm CET (Mar. 28, 2014).
Nigel Whitfield: "Fake tape detectors, 'from the stands' footie and UGH? Internet of Things in my set-top box"; http://www.theregister.co.uk/2014/09/24/ibc_round_up_object_audio_dlna_iot/ (Sep. 24, 2014).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for the Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).
Wikipedia, "Gamebook", https://en.wikipedia.org/wiki/Gamebook, Sep. 3, 2017, 5 pages.
Wikipedia, "Kinect", "https://en.wikipedia.org/wiki/Kinect", 18 pages, (Sep. 9, 2017).
Wikipedia, "Wii Balance Board", "https://en.wikipedia.org/wiki/Wii_Balance_Board", 3 pages, (Jul. 20, 2017).

* cited by examiner

COMPARATIVE ANALYSIS OF SENSORS TO CONTROL POWER STATUS FOR WIRELESS EARPIECES

PRIORITY STATEMENT

This application claims priority to U.S. Provisional Patent Application No. 62/359,316, filed on Jul. 7, 2016, and entitled "COMPARATIVE ANALYSIS OF SENSORS TO CONTROL POWER STATUS FOR WIRELESS EARPIECES", hereby incorporated by reference in its entirety.

BACKGROUND

I. Field of the Disclosure

The illustrative embodiments relate to wireless earpieces. More specifically, but not exclusively, the illustrative embodiments relate to managing power settings for wireless earpieces utilizing light detection or sensed movement.

II. Description of the Art

The growth of wearable devices is increasing exponentially. This growth is fostered by the decreasing size of microprocessors, circuitry boards, chips, and other components. Wearable devices are necessarily dependent upon their batteries in order to complete their desired function. The overall utility of wearable devices is directly proportional to the battery life of the devices. If the battery life is poor, the user interface and user experiences suffers as too much time and attention are required for retrieving the device, recharging the battery, and repositioning the wearable device. Operation and conservation of the battery life of the wearable device may be further complicated if the wireless earpieces unnecessarily utilize power.

SUMMARY OF THE DISCLOSURE

One embodiment of the illustrative embodiments provides a system, method, and wireless earpieces for managing power settings. Sensor measurements are performed utilizing a first sensor array of the wireless earpieces to detect light and motion. Sensor measurements are performed utilizing a second sensor array of the wireless earpieces to detect light and motion. The sensor measurements are analyzed from the first sensor array and the second sensor array. A determination is made whether a change event is detected in response to the sensor measurements. The change event is confirmed as detected. The wireless earpieces enter a full power mode in response to the change event being confirmed. Another embodiment provides wireless earpieces including a processor and a memory storing a set of instructions. The set of instructions are executed to perform the method described.

Another embodiment provides a wireless earpiece. The wireless earpiece may include a frame for fitting in an ear of a user. The wireless earpiece may also include a logic engine controlling functionality of the wireless earpiece. The wireless earpiece may also a number of sensors including at least a first sensor array and a second sensor array for performing sensor measurements including detecting changes in light and motion. The wireless earpiece may also include a transceiver communicating with at least a wireless device. The logic engine analyzes the sensor measurements from the first sensor array and the second sensor array, determine whether a change event is detected in response to the sensor measurements, confirms the change event is detected, and enters a full power mode of the wireless earpiece in response to the change event being confirmed.

BRIEF DESCRIPTION OF THE DRAWINGS

Illustrated embodiments of the present invention are described in detail below with reference to the attached drawing figures, which are incorporated by reference herein, and where.

DETAILED DESCRIPTION OF THE DISCLOSURE

Figure 1:
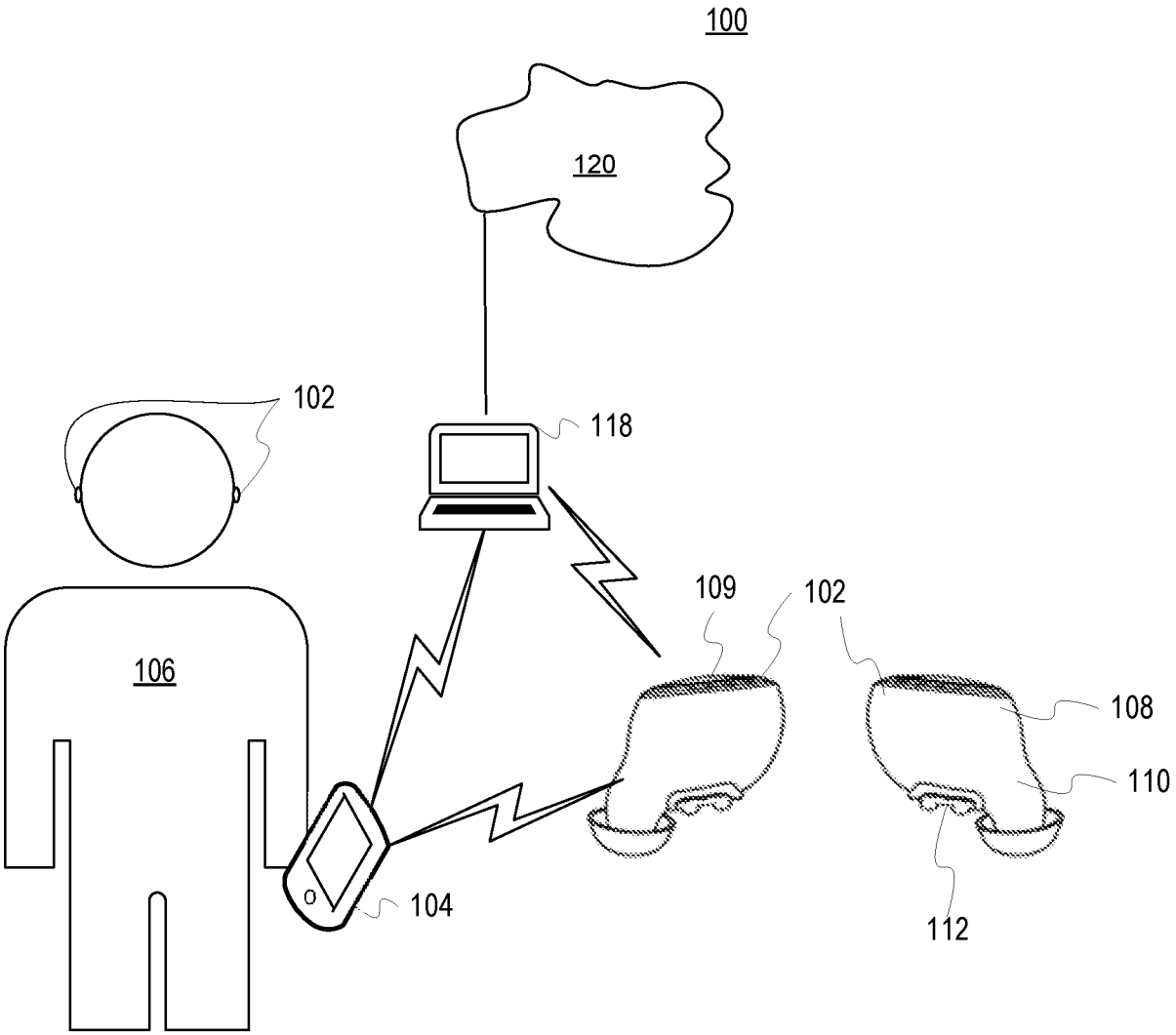
FIG. 1 is a pictorial representation of a communication system in accordance with an illustrative embodiment.

The illustrative embodiments provide a system, method, wireless earpieces, and personal area network for managing power utilization of wireless earpieces. The wireless earpieces may utilize a low power mode to preserve battery life when changes in light conditions or motion are not detected. As a result, the power capacity of the wireless earpieces may be reserved for utilization by a user rather than wasted when not in use or even visible to the user. Preserving the battery life or power available is particularly important because of the reduced size of the wireless earpieces and the limited space available for the battery. In addition, the wireless earpieces may become particularly important to a user for business, exercise, or personal activities and, therefore, merit preserving power whenever possible to optimize the user's experience.

The wireless earpieces may be utilized to play music or audio, track user biometrics, perform communications (e.g., two-way, alerts, etc.), provide feedback/input, and any number of tasks. The wireless earpieces may execute software or sets of instructions stored in an on-board memory utilizing a processor to accomplish numerous tasks. The wireless earpieces may also be utilized to control, communicate, manage, or interact with a number of other computing, communications, or wearable devices, such as smart phones, laptops, personal computers, tablets, vehicles, smart glasses, helmets, smart glass, watches or wrist bands, chest straps, implants, displays, clothing, or so forth. In one embodiment, the wireless earpieces may be part of a personal area network. A personal area network is a network for data transmissions among devices, such as personal computing, communications, camera, vehicles, entertainment, and medical devices. The personal area network may utilize any number of wired, wireless, or hybrid configurations and may be stationary or dynamic. For example, the personal area network may utilize wireless network protocols or standards, such as INSTEON, IrDA, Wireless USB, near field magnetic induction (NFMI), Bluetooth, Z-Wave, ZigBee, Wi-Fi, ANT+ or other applicable radio frequency signals. In one embodiment, the personal area network may move with the user.

Any number of conditions, factors, and so forth may be utilized to determine whether the wireless earpieces should enter a low power, sleep, hibernation, or other reduced power mode, status, or configuration. In one embodiment, 1) changes in light conditions detected by at least two sensors may be utilized, and 2) detection of a movement event by the wireless earpieces and/or other interconnected devices may be utilized to determine whether a low power mode should be activated.

In one embodiment, ambient light may be detected by a first set of infrared detectors that are housed in or near an exterior or outer surface of the wireless earpieces. The infrared sensors may be utilized to detect finger touches or gestures that control the features and functionality when the wireless earpieces are being worn. A second set of optical sensors may be positioned against the ear of the user when worn. The second set of optical sensors may include light emitting diodes (LEDs) configured to perform measurements within the ear of the user to measure biometrics, such as pulse rate, blood pressure, temperature, respiration rate, blood oxygenation, blood chemical levels, and other discernable information.

The utilization of the two sets of spatially separated optical sensors provides for enhanced detection and analysis. Light and motion changes made be made by the first set of infrared detectors and the second set of optical sensors and compared to determine whether actual light or motion changes are detected. As a result, false positives associated with perceived changes in light or motion may be reduced or eliminated. The battery power of the wireless earpieces is conserved for user utilization of the wireless earpieces. For example, the charge of the batteries (e.g., batteries of the wireless earpieces, packaging batteries, etc.) may be conserved on store shelves when the wireless earpieces are still incorporated in original packaging.

The wireless earpieces may include any number of sensors for reading user biometrics, such as pulse rate, blood pressure, blood oxygenation, temperature, calories expended, blood or sweat chemical content, voice and audio output, impact levels, and orientation (e.g., body, head, etc.). The sensors may also determine the user's location, position, velocity, impact levels, and so forth. The sensors may also receive user input and convert the user input into commands or selections made across the personal devices of the personal area network. For example, the user input detected by the wireless earpieces may include voice commands, head motions, finger taps, finger swipes, motions or gestures, or other user inputs sensed by the wireless earpieces. The user input may be determined and converted into commands that may be sent to one or more external devices, such as a tablet computer, smart phone, or so forth.

The wireless earpieces may perform sensor measurements for the user to read any number of user biometrics. The user biometrics may be analyzed including measuring deviations or changes of the sensor measurements over time, identifying trends of the sensor measurements, and comparing the sensor measurements to control data for the user.

FIG. 1 is a pictorial representation of a communications environment 100 in accordance with an illustrative embodiment. The wireless earpieces 102 may be configured to communicate with each other and with one or more wireless devices, such as a wireless device 104 or a personal computer 118. The wireless earpieces 102 may be worn by a user 106 and are shown as worn and separately from their positioning within the ears of the user 106 for purposes of visualization. A block diagram of the wireless earpieces 102 if further shown in FIG. 2 to further illustrate components and operation of the wireless earpieces 102.

In one embodiment, the wireless earpieces 102 includes a frame 108 shaped to fit substantially within the ears of the user 106. The frame 108 is a support structure that at least partially encloses and houses the electronic components of the wireless earpieces 102. The frame 108 may be composed of a single structure or multiple structures that are interconnected. An exterior portion of the wireless earpieces 102 may include a first set of sensors shown as infrared sensors 109. The infrared sensors 109 may include emitter and receivers that detects and measures infrared light radiating from objects in its field of view. The infrared sensors 109 may detect gestures, touches, or other user input against an exterior portion of the wireless earpieces 102 that is visible when worn by the user 106. The infrared sensors 109 may also detect infrared light or motion. The infrared sensors 109 may be utilized to determine whether the wireless earpieces 102 are being worn, moved, approached by a user, set aside, stored in a smart case, placed in a dark environment, or so forth. This information may be utilized to determine whether the wireless earpieces should be in a low power mode for conserving battery capacity or a full power mode for actual usage or preparing for utilization by the user 106. In one embodiment, the infrared sensors 109 may also include detectors for measuring light from any number of wavelengths (e.g., visible light within a room or other environment).

The frame 108 defines an extension 110 configured to fit substantially within the ear of the user 106. The extension 110 may include one or more speakers or vibration components for interacting with the user 106. The extension 110 may be removable covered by one or more sleeves. The sleeves may be changed to fit the size and shape of the user's ears. The sleeves may come in various sizes and have extremely tight tolerances to fit the user 106 and one or more other users that may utilize the wireless earpieces 102 during their expected lifecycle. In another embodiment, the sleeves may be custom built to support the interference fit utilized by the wireless earpieces 102 while also being comfortable while worn. The sleeves are shaped and configured to not cover various sensor devices of the wireless earpieces 102.

In one embodiment, the frame 108 or the extension 110 (or other portions of the wireless earpieces 102) may include sensors 112 for sensing pulse, blood oxygenation, temperature, voice characteristics, skin conduction, glucose levels, impacts, activity level, position, location, orientation, as well as any number of internal or external user biometrics. In other embodiments, the sensors 112 may be positioned to contact or be proximate the epithelium of the external auditory canal or auricular region of the user's ears when worn. For example, the sensors 112 may represent various metallic sensor contacts, optical interfaces, or even microdelivery systems for receiving, measuring, and delivering information and signals. Small electrical charges or spectroscopy emissions (e.g., various light wavelengths) may be utilized by the sensors 112 to analyze the biometrics of the user 106 including pulse, blood pressure, skin conductivity, blood analysis, sweat levels, and so forth. In one embodiment, the sensors 112 may include optical sensors that may emit and measure reflected light within the ears of the user 106 to measure any number of biometrics. The optical sensors may also be utilized as a second set of sensors to determine when the wireless earpieces 102 are in use, stored, charging, or otherwise positioned. The optical sensors may be utilized to preserve battery power of the wireless earpieces 102 when not being actively utilized by the user 102 or being retrieved to be worn. In one embodiment, the sensors 112 may be utilized in addition to the infrared sensors 109 to determine the power mode or status utilized by the wireless earpieces 102. The sensors 112 may similarly detect changes in motion, light, or user contact that may be utilized to select the associated power mode for preserving battery life. The sensors 112 may also be utilized to sense or provide a small electrical current which may be useful for alerting the user, stimulating blood flow, alleviating nausea, or so forth.

In some applications, temporary adhesives or securing mechanisms (e.g., clamps, straps, lanyards, extenders, etc.) may be utilized to ensure that the wireless earpieces 102 remain in the ears of the user 106 even during the most rigorous and physical activities or that if they do fall out they are not lost or broken. For example, the wireless earpieces 102 may be utilized during marathons, swimming, team sports, biking, hiking, parachuting, or so forth. The wireless earpieces 102 may be configured to play music or audio, receive and make phone calls or other communications, determine ambient environmental conditions (e.g., temperature, altitude, location, speed, heading, etc.), read user biometrics (e.g., heart rate, motion, temperature, sleep, blood oxygenation, voice output, calories burned, forces experienced, etc.), and receive user input, feedback, or instructions. The wireless earpieces 102 may be utilized with any number of automatic assistants, such as Siri, Cortana, or other smart assistants/artificial intelligence systems.

The communications environment 100 may further include the personal computer 118. The personal computer 118 may communicate with one or more wired or wireless networks, such as a network 120. The personal computer 118 may represent any number of devices, systems, equipment, or components, such as a laptop, server, tablet, medical system, or so forth. The personal computer 118 may communicate utilize any number of standards, protocols, or processes. For example, the personal computer 118 may utilize a wired or wireless connection to communicate with the wireless earpieces 102, the wireless device 104, or other electronic devices. The personal computer 118 may utilize any number of memories or databases to store or synchronize biometric information associated with the user 106, data, passwords, or media content.

The wireless earpieces 102 may determine their position with respect to each other as well as the wireless device 104 and the personal computer 118. For example, position information for the wireless earpieces 102 and the wireless device 104 may determine proximity of the devices in the communications environment 100. For example, global positioning information or signal strength/activity may be utilized to determine proximity and distance of the devices to each other in the communications environment 100. In one embodiment, the distance information may be utilized to determine whether biometric analysis may be displayed to a user. For example, the wireless earpieces 102 may be required to be within four feet of the wireless device 104 and the personal computer 118 in order to display biometric readings or receive user input. The transmission power or amplification of received signals may also be varied based on the proximity of the devices in the communications environment 100.

In one embodiment, the wireless earpieces 102 and the corresponding sensors 112 (whether internal or external) may be configured to take a number of measurements or log information during normal usage. The sensor measurements may be utilized to extrapolate other measurements, factors, or conditions applicable to the user 106 or the communications environment 100. For example, the sensors 112 may monitor the user's usage patterns or light sensed in the communications environment 100 to enter a full power mode in a timely manner. The user 106 or another party may configure the wireless earpieces 102 directly or through a connected device and app (e.g., mobile app with a graphical user interface) to set power settings (e.g., preferences, conditions, parameters, settings, factors, etc.) or to store or share biometric information, audio, and other data. In one embodiment, the user may establish the light conditions or motion that may activate the full power mode or that may keep the wireless earpieces 102 in a sleep or low power mode. As a result, the user 106 may configure the wireless earpieces 102 to maximize the battery life based on motion, lighting conditions, and other factors established for the user. For example, the user 106 may set the wireless earpieces 102 to enter a full power mode only if positioned within the ears of the user 106 within ten seconds of being moved, otherwise the wireless earpieces 102 remain in a low power mode to preserve battery life. This setting may be particularly useful if the wireless earpieces 102 are periodically moved or jostled without being inserted into the ears of the user 106.

The user 106 or another party may also utilize the wireless device 104 to associate user information and conditions with the power state. For example, an application executed by the wireless device 104 may be utilized to specify the conditions that may "wake up" the wireless earpieces 102 including all or a portion of the functionality that may correspond to a full power mode. In addition, the power states and enabled functions (e.g., sensors, transceivers, vibration alerts, speakers, lights, etc.) may be selectively activated during each power state. In another embodiment, the wireless earpieces 102 may be adjusted or trained over time to become even more accurate in adjusting between power modes. The wireless earpieces 102 may utilize historical information to generate default values, baselines, thresholds, policies, or settings for determining when and how the power modes are implemented. As a result, the wireless earpieces 102 may effectively manage the power capacity based on automatic detection of events (e.g., light, motion, etc.) and user specified settings.

The wireless earpieces 102 may include any number of sensors 112 and logic for measuring and determining user biometrics, such as pulse rate, skin conduction, blood oxygenation, temperature, calories expended, blood or excretion chemistry, voice and audio output, position, and orientation (e.g., body, head, etc.). The sensors 112 may also determine the user's location, position, velocity, impact levels, and so forth. Any of the sensors 112 may be utilized to detect or confirm light, motion, or other parameters that may affect how the wireless earpieces 102 manage power utilization. The sensors 112 may also receive user input and convert the user input into commands or selections made across the personal devices of the personal area network. For example, the user input detected by the wireless earpieces 102 may include voice commands, head motions, finger taps, finger swipes, motions or gestures, or other user inputs sensed by the wireless earpieces. The user input may be determined by the wireless earpieces 102 and converted into authorization commands that may be sent to one or more external devices, such as the wireless device 104, the personal computer 118, a tablet computer, or so forth. For example, the user 106 may create a specific head motion and voice command that when detected by the wireless earpieces 102 are utilized to put the wireless earpieces 102 in a sleep mode in anticipation of taking the wireless earpieces 102 out of the ears of the user 106.

The sensors 112 may make all of the measurements with regard to the user 106 and communications environment 100 or may communicate with any number of other sensory devices, components, or systems in the communications environment 100. In one embodiment, the communications environment 100 may represent all or a portion of a personal area network. The wireless earpieces 102 may be utilized to control, communicate, manage, or interact with a number of other wearable devices or electronics, such as smart glasses, helmets, smart glass, watches or wrist bands, other wireless earpieces, chest straps, implants, displays, clothing, or so forth. A personal area network is a network for data transmissions among devices, such as personal computing, communications, camera, vehicles, entertainment, and medical devices. The personal area network may utilize any number of wired, wireless, or hybrid configurations and may be stationary or dynamic. For example, the personal area network may utilize wireless network protocols or standards, such as INSTEON, IrDA, Wireless USB, Bluetooth, Z-Wave, ZigBee, Wi-Fi, ANT+ or other applicable radio frequency signals. In one embodiment, the personal area network may move with the user 106.

In other embodiments, the communications environment 100 may include any number of devices, components, or so forth that may communicate with each other directly or indirectly through a wireless (or wired) connection, signal, or link. The communications environment 100 may include one or more networks and network components and devices represented by the network 120, such as routers, servers, signal extenders, intelligent network devices, computing devices, or so forth. In one embodiment, the network 120 of the communications environment 100 represents a personal area network as previously disclosed. The power settings and management herein described may also be utilized for any number of devices in the communications environment 100 with commands or communications being sent by the wireless earpieces 102 or wireless device 104 to control the power settings for the devices.

Communications within the communications environment 100 may occur through the network 120 or a Wi-Fi network or may occur directly between devices, such as the wireless earpieces 102 and the wireless device 104. The network 120 may communicate with or include a wireless network, such as a Wi-Fi, cellular (e.g., 3G, 4G, 5G, PCS, GSM, etc.), Bluetooth, or other short range or long range radio frequency networks. The network 120 may also include or communicate with any number of hard wired networks, such as local area networks, coaxial networks, fiber-optic networks, network adapters, or so forth. Communications within the communications environment 100 may be operated by one or more users, service providers, or network providers.

The wireless earpieces 102 may play, display, communicate, or utilize any number of alerts or communications to indicate that the power settings, mode, or status in use or being implemented. For example, one or more alerts may indicate when power state changes are pending, in process, authorized, and/or changing with specific tones, verbal acknowledgements, tactile feedback, or other forms of communicated messages. For example, an audible alert and LED flash may be utilized each time the wireless earpieces 102 change the power state. The corresponding alert may also be communicated to the user 106, the wireless device 104, and the personal computer 118.

In other embodiments, the wireless earpieces 102 may also vibrate, flash, play a tone or other sound, or give other indications of the power status of the wireless earpieces 102. The wireless earpieces 102 may also communicate an alert to the wireless device 104 that shows up as a notification, message, or other indicator indicating the changed status.

The wireless earpieces 102 as well as the wireless device 104 may include logic for automatically implementing power management functions in response to motion, light, or various other conditions and factors of the communications environment 100.

The wireless device 104 may represent any number of wireless or wired electronic communications or computing devices, such as smart phones, laptops, desktop computers, control systems, tablets, displays, gaming devices, music players, personal digital assistants, vehicle systems, or so forth. The wireless device 104 may communicate utilizing any number of wireless connections, standards, or protocols (e.g., near field communications, NFMI, Bluetooth, Wi-Fi, wireless Ethernet, etc.). For example, the wireless device 104 may be a touch screen cellular phone that communicates with the wireless earpieces 102 utilizing Bluetooth communications. The wireless device 104 may implement and utilize any number of operating systems, kernels, instructions, or applications that may make use of the available sensor data sent from the wireless earpieces 102. For example, the wireless device 104 may represent any number of android, iOS, Windows, open platforms, or other systems and devices. Similarly, the wireless device 104 or the wireless earpieces 102 may execute any number of applications that utilize the user input, proximity data, biometric data, and other feedback from the wireless earpieces 102 to initiate, authorize, or process power management processes and perform the associated tasks.

As noted, the layout of the internal components of the wireless earpieces 102 and the limited space available for a product of limited size may affect where the sensors 112 may be positioned. The positions of the sensors 112 within each of the wireless earpieces 102 may vary based on the model, version, and iteration of the wireless earpiece design and manufacturing process.

Figure 2:
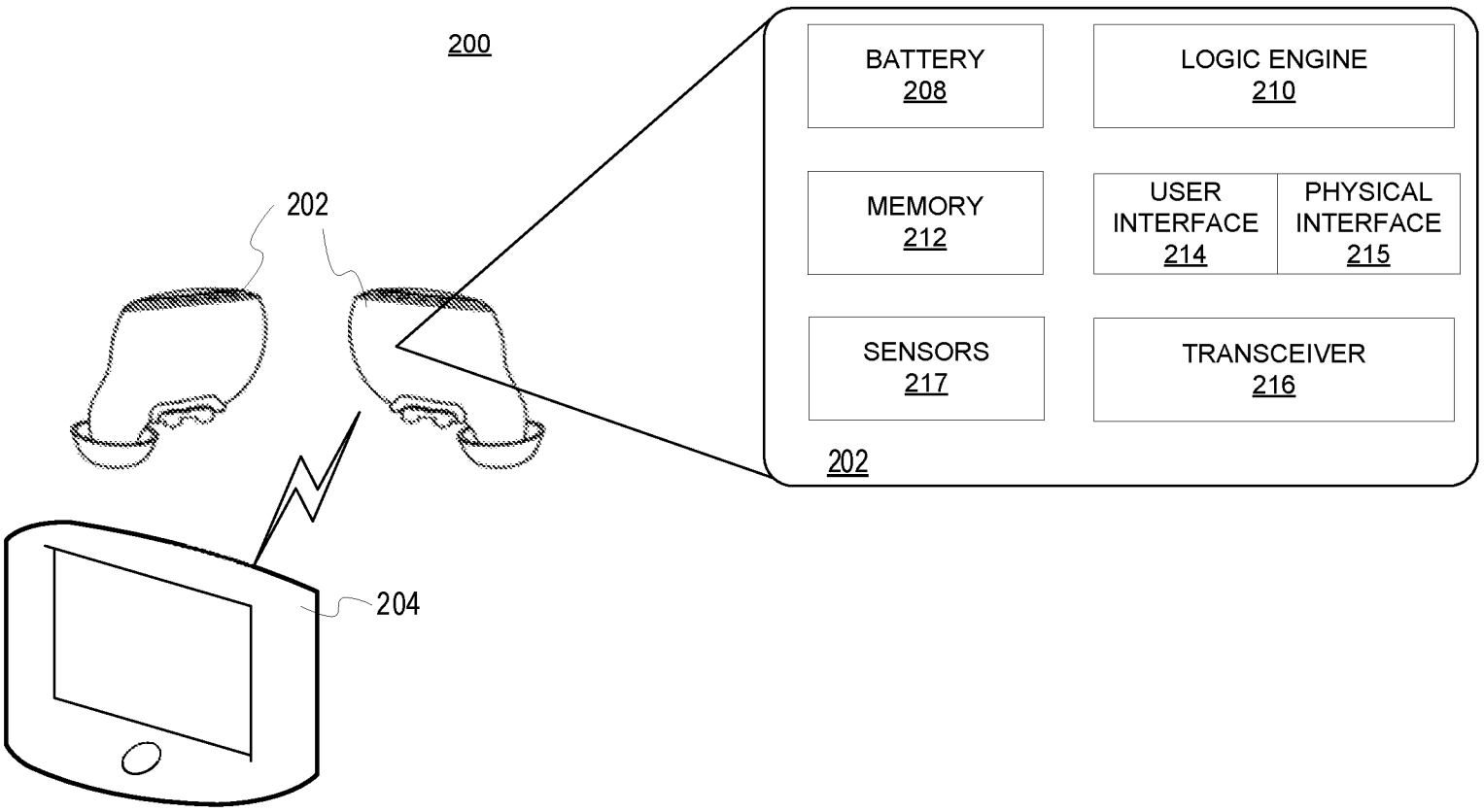
FIG. 2 is a block diagram of wireless earpieces in accordance with an illustrative embodiment.

FIG. 2 is a block diagram of a wireless earpiece system 200 in accordance with an illustrative embodiment. In one embodiment, the wireless earpiece system 200 may include wireless earpieces 202 (described collectively rather than individually). In one embodiment, the wireless earpiece system 200 may enhance communications and functionality of the wireless earpieces 202.

As shown, the wireless earpieces 202 may be wirelessly linked to a computing device 204. For example, the computing device 204 may represent a wireless tablet computer. The computing device 204 may also represent a gaming device, cell phone, vehicle system (e.g., GPS, speedometer, pedometer, entertainment system, etc.), gaming device, smart watch, laptop, smart glass, or other electronic devices. User input and commands may be received from either the wireless earpieces 202 or the computing device 204 for implementation on either of the devices of the wireless earpiece system 200 (or other externally connected devices). As previously noted, the wireless earpieces 202 may be referred to or described herein as a pair (wireless earpieces) or singularly (wireless earpiece). The description may also refer to components and functionality of each of the wireless earpieces 202 collectively or individually.

In some embodiments, the computing device 204 may act as a logging tool for receiving information, data, or measurements made by the wireless earpieces 202. For example, the computing device 204 may download data from the wireless earpieces 202 in real-time. As a result, the computing device 204 may be utilized to store, display, and synchronize data for the wireless earpieces 202. For example, the computing device 204 may display pulse, proximity, location, oxygenation, distance, calories burned, and so forth as measured by the wireless earpieces 202. The computing device 204 may be configured to receive and display alerts that indicate conditions to enter a low power mode have been met. For example, the wireless earpieces 202 may utilize factors, such as changes in motion or light, distance threshold between the wireless earpieces 202 and/or computing device 204, signal activity, or other automatically determined or user specified measurements, factors, conditions, or parameters, the wireless earpieces 202 may enter the low power mode and generate a message to the computing device 204 indicating the wireless earpieces 202 have entered the low power mode.

The computing device 204 may also include a number of optical sensors, touch sensors, and other measurement devices that may provide feedback or measurements that the wireless earpieces 202 may utilize to determine an appropriate power mode, settings, or enabled functionality to be utilized. The wireless earpieces 202 and the computing device 204 may have any number of electrical configurations, shapes, and colors and may include various circuitry, connections, and other components.

In one embodiment, the wireless earpieces 202 may include a battery 208, a logic engine 210, a memory 212, a user interface 214, a physical interface 215, a transceiver 216, and sensors 217. The computing device 204 may have any number of configurations and include components and features similar to the wireless earpieces 202 as are known in the art.

The battery 208 is a power storage device configured to power the wireless earpieces 202. In other embodiments, the battery 208 may represent a fuel cell, thermal electric generator, piezo electric charger, solar charger, ultra-capacitor, or other existing or developing power storage technologies. The illustrative embodiments preserve the capacity of the battery 208 by reducing unnecessary utilization of the wireless earpieces 202 in a full-power mode when there is little or no benefit to the user (e.g., the wireless earpieces 202 are sitting on a table or temporarily lost). The battery 208 or power of the wireless earpieces are preserved for when being worn or operated by the user. As a result, user satisfaction with the wireless earpieces 202 is improved and the user may be able to set the wireless earpieces 202 aside at any moment knowing that battery life is automatically preserved by the logic engine 210 and functionality of the wireless earpieces 202.

The logic engine 210 is the logic that controls the operation and functionality of the wireless earpieces 202. The logic engine 210 may include circuitry, chips, and other digital logic. The logic engine 210 may also include programs, scripts, and instructions that may be implemented to operate the logic engine 210. The logic engine 210 may represent hardware, software, firmware, or any combination thereof. In one embodiment, the logic engine 210 may include one or more processors. The logic engine 210 may also represent an application specific integrated circuit (ASIC) or field programmable gate array (FPGA).

The logic engine 210 may utilize motion or light measurements from two or more of the sensors 217 to determine whether the wireless earpieces 202 are in use or being stored. The logic engine 210 may control a power mode utilized by the wireless earpieces 202 in response to any number of measurements from the sensors 217, the transceiver 216, the user interface 214, or the physical interface 215. The logic engine 210 may also shut down all or portions of the components of the wireless earpieces 202 to preserve the life of the battery 208 based on the applicable condition or state of the wireless earpieces (e.g., worn and in-use, setting on a desk and unused, in a smart charger, etc.).

In addition, the logic engine 210 may utilize the signal strength sensed by the transceiver 216 to determine the proximity of the wireless earpieces 202 to each other as well as the computing device 204. The logic engine 210 may also determine whether the wireless earpieces 202 are actively performing any user-requested functions that indicate the wireless earpieces 202 are active. For example, the logic engine may determine whether music is being played, communications being received, processed, or sent, noise-cancellation is being performed and so forth. Utilizing the proximity information and signal activity, the logic engine 210 may provide instructions to enter the low power mode. In one embodiment, the logic engine 210 may turn off or reduce power to most of the components of the wireless earpieces. For example, the logic engine 210 may completely power down the wireless earpieces 202 requiring the user to turn the wireless earpieces 202 back on in response to detecting no changes in light or motion for more than 2 hours. In another example, the logic engine 210 may turn off power to most of the components except for the sensors 217 and logic engine 210 that may periodically determine whether motion, light, or user feedback is received. If user feedback or communications are detected or received, the logic engine 210 may wake up or power up the wireless earpieces 202 from the low power mode to a regular or full-power mode. The wireless earpieces 202 may be configured to work together or completely independently based on the needs of the user.

The logic engine 210 may also process user input to determine commands implemented by the wireless earpieces 202 or sent to the wireless earpieces 204 through the transceiver 216. Specific actions may be associated with power modes. For example, the logic engine 210 may implement a macro allowing the user to associate common conditions with specific modes of operation, such as normal operations (full power mode) for when the wireless earpieces 202 are positioned within the ears of the user, low power mode when the wireless earpieces 1) are not being worn by the user, and 2) do not detect changes in light and motion, recharge mode when the wireless earpieces 202 and are close together (e.g., closer than when worn in the ears of the user) within in the smart case, low power mode if the wireless earpieces 202 are not being worn and close together, low power mode for each of the wireless earpieces 202 if separated by a significant distance and not being worn, and any number of other conditions. The logic engine 210 may utilize two sensor arrays (e.g., infrared, LED, etc.) to detect light and motion.

In one embodiment, a processor included in the logic engine 210 is circuitry or logic enabled to control execution of a set of instructions. The processor may be one or more microprocessors, digital signal processors, application-specific integrated circuits (ASIC), central processing units, or other devices suitable for controlling an electronic device including one or more hardware and software elements, executing software, instructions, programs, and applications, converting and processing signals and information, and performing other related tasks.

The memory 212 is a hardware element, device, or recording media configured to store data or instructions for subsequent retrieval or access at a later time. The memory 212 may represent static or dynamic memory. The memory 212 may include a hard disk, random access memory, cache, removable media drive, mass storage, or configuration suitable as storage for data, instructions, and information. In one embodiment, the memory 212 and the logic engine 210 may be integrated. The memory may use any type of volatile or non-volatile storage techniques and mediums. The memory 212 may store information related to the status of a user, wireless earpieces 202, computing device 204, and other peripherals, such as a wireless device, smart glasses, a smart watch, a smart case for the wireless earpieces 202, a wearable device, and so forth. In one embodiment, the memory 212 may display instructions, programs, drivers, or an operating system for controlling the user interface 214 including one or more LEDs or other light emitting components, speakers, tactile generators (e.g., vibrator), and so forth. The memory 212 may also store thresholds, conditions, signal or processing activity, proximity data, and so forth.

The transceiver 216 is a component comprising both a transmitter and receiver which may be combined and share common circuitry on a single housing. The transceiver 216 may communicate utilizing Bluetooth, Wi-Fi, ZigBee, Ant+, near field communications, wireless USB, infrared, mobile body area networks, ultra-wideband communications, cellular (e.g., 3G, 4G, 5G, PCS, GSM, etc.), infrared, or other suitable radio frequency standards, networks, protocols, or communications. The transceiver 216 may also be a hybrid or multi-mode transceiver that supports a number of different communications. For example, the transceiver 216 may communicate with the computing device 204 or other systems utilizing wired interfaces (e.g., wires, traces, etc.), NFC or Bluetooth communications and with the other wireless earpiece utilizing NFMI. The transceiver 216 may also detect amplitudes and infer distance between the wireless earpieces 202. The transceiver 216 may also detect amplitudes for determining the distance to the computing device 204.

The components of the wireless earpieces 202 may be electrically connected utilizing any number of wires, contact points, leads, busses, wireless interfaces, or so forth. In addition, the wireless earpieces 202 may include any number of computing and communications components, devices or elements which may include busses, motherboards, circuits, chips, sensors, ports, interfaces, cards, converters, adapters, connections, transceivers, displays, antennas, and other similar components. The physical interface 215 is hardware interface of the wireless earpieces 202 for connecting and communicating with the computing device 204 or other electrical components, devices, or systems.

The physical interface 215 may include any number of pins, arms, or connectors for electrically interfacing with the contacts or other interface components of external devices or other charging or synchronization devices. For example, the physical interface 215 may be a micro USB port. In one embodiment, the physical interface 215 is a magnetic interface that automatically couples to contacts or an interface of the computing device 204. In another embodiment, the physical interface 215 may include a wireless inductor for charging the wireless earpieces 202 without a physical connection to a charging device.

The user interface 214 is a hardware interface for receiving commands, instructions, or input through the touch (haptics) of the user, voice commands, or predefined motions. The user interface 214 may be utilized to control the other functions of the wireless earpieces 202. The user interface 214 may include the LED array, one or more touch sensitive buttons or portions, a miniature screen or display, or other input/output components. The user interface 214 may be controlled by the user or based on commands received from the computing device 204 or a linked wireless device. For example, the user may turn on, reactivate, or provide feedback utilizing the user interface 214.

In one embodiment, the user may provide feedback by tapping the user interface 214 once, twice, three times, or any number of times. Similarly, a swiping motion may be utilized across or in front of the user interface 214 (e.g., the exterior surface of the wireless earpieces 202) to implement a predefined action. Swiping motions in any number of directions or gestures may be associated with specific activities, such as play music, pause, fast forward, rewind, activate a digital assistant (e.g., Siri, Cortana, smart assistant, etc.). The swiping motions may also be utilized to control actions and functionality of the computing device 204 or other external devices (e.g., smart television, camera array, smart watch, etc.). The user may also provide user input by moving his head in a particular direction or motion or based on the user's position or location. For example, the user may utilize voice commands, head gestures, or touch commands to change the content displayed by the computing device 204. The user interface 214 may also provide a software interface including any number of icons, soft buttons, windows, links, graphical display elements, and so forth.

In one embodiment, the sensors 217 may be integrated with the user interface 214 to detect or measure the user input. For example, infrared sensors positioned against an outer surface of the wireless earpieces 202 may detect touches, gestures, or other input as part of a touch or gesture sensitive portion of the user interface 214. The outer or exterior surface of the user interface 214 may correspond to a portion of the wireless earpieces 202 accessible to the user when the wireless earpieces are worn within the ears of the user.

In addition, the sensors 217 may include pulse oximeters, accelerometers, gyroscopes, magnetometers, inertial sensors, photo detectors, miniature cameras, and other similar instruments for detecting user biometrics, environmental conditions, location, utilization, orientation, motion, and so forth. The sensors 217 may also be utilized to determine whether the wireless earpieces 202 are being actively utilized. The sensors 217 may provide measurements or data that may be utilized to select, activate, or enter a low power mode. Likewise, the sensors 217 may be utilized to awake, activate, initiated, or otherwise enter a full power or normal mode for the wireless earpieces 202. For example, the optical biosensors within the sensors 217 may determine whether the wireless earpieces 202 are being worn or whether there are changes in motion or light indicative of the wireless earpieces 202 being picked up for usage. Similarly, a lack of changes in motion or light as well as no detectable contact with the user may be utilized to enter or maintain a low power mode.

The computing device 204 may include components similar in structure and functionality to those shown for the wireless earpieces 202. The computing device may include any number of processors, batteries, memories, busses, motherboards, chips, transceivers, peripherals, sensors, displays, cards, ports, adapters, interconnects, and so forth. In one embodiment, the computing device 204 may include one or more processors and memories for storing instructions. The instructions may be executed as part of an operating system, application, browser, or so forth to implement the features herein described. In one embodiment, the wireless earpieces 202 may be magnetically or physically coupled to the computing device 204 to be recharged or synchronized or to be stored.

The computing device 204 may also execute an application with settings or conditions for entering a low power mode and full power mode. The user may adjust and program the settings including thresholds, activities, conditions, environmental factors, and so forth. In one embodiment, the sensors of the computing device 204 may also be utilized to determine whether the wireless earpieces 202 should enter a full power mode or low power mode.

In another embodiment, the computing device 204 may also include sensors for detecting the location, orientation, and proximity of the wireless earpieces 202 to the computing device 204. The wireless earpieces 202 may turn off communications to the computing device 204 in response to losing a status or heart beat connection to preserve battery life and may only periodically search for a connection, link, or signal to the computing device 204.

As originally packaged, the wireless earpieces 202 and the computing device 204 may include peripheral devices such as charging cords, power adapters, inductive charging adapters, solar cells, batteries, lanyards, additional light arrays, speakers, smart case covers, transceivers (e.g., Wi-Fi, cellular, etc.), or so forth. In one embodiment, the wireless earpieces 202 may include a smart case (not shown). The smart case may include an interface for charging the wireless earpieces 202 from an internal battery. The smart case may also utilize the interface or a wireless transceiver to log utilization, biometric information of the user, and other information and data.

Figure 3:
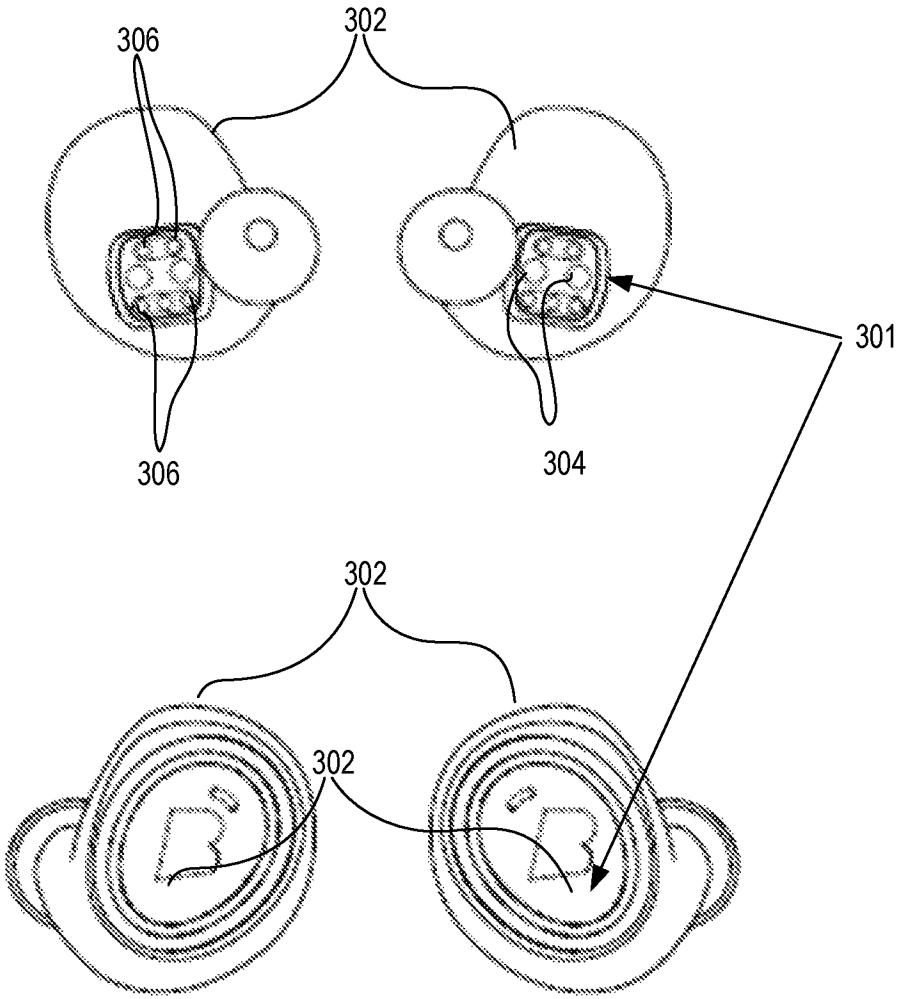
FIG. 3 is a pictorial representation of sensors of the wireless earpieces in accordance with illustrative embodiments.

FIG. 3 is a pictorial representation of sensors 301 of the wireless earpieces 302 in accordance with illustrative embodiments. As previously noted, the wireless earpieces 302 may include any number of internal or external sensors. The sensors 301 may make independent measurements or combined measurements utilizing the sensory functionality of each of the sensors to measure, confirm, or verify sensor measurements.

In one embodiment, the sensors 301 may include optical sensors 304 and contact sensors 306. The optical sensors 304 may generate an optical signal that is communicated to the ear (or other body part) of the user and reflected back. The reflected optical signal may be analyzed to determine blood pressure, pulse rate, pulse oximetry, vibrations, blood chemistry, and other information about the user. The optical sensors 304 may include any number of sources for outputting various wavelengths of electromagnetic radiation and visible light. Thus, the wireless earpieces 302 may utilize spectroscopy as it is known in the art and developing to determine any number of user biometrics.

The optical sensors 304 may also be configured to detect ambient light proximate the wireless earpieces 302. For example, the optical sensors 304 may detect light and light changes in an environment of the wireless earpieces, such as in a room where the wireless earpieces 302 are located. The optical sensors 304 may be configured to detect any number of wavelengths including visible light that may be relevant to light changes, approaching users or devices, and so forth.

In another embodiment, the contact sensors 306 may be utilized to determine that the wireless earpieces 302 are positioned within the ears of the user. For example, conductivity of skin or tissue within the user's ear may be utilized to determine that the wireless earpieces are being worn. In other embodiments, the contact sensors 306 may include pressure switches, toggles, or other mechanical detection components for determining that the wireless earpieces 302 are being worn. The contact sensors 306 may measure or provide additional data points and analysis that may indicate the biometric information of the user. The contact sensors 306 may also be utilized to apply electrical, vibrational, motion, or other input, impulses, or signals to the skin of the user.

The wireless earpieces 302 may also include infrared sensors 308. The infrared sensors 308 may be utilized to detect touch, contact, gestures, or other user input. The infrared sensors 308 may detect infrared wavelengths and signals. In another embodiment, the infrared sensors 308 may detect visible light or other wavelengths as well. The infrared sensors 308 may be configured to detect light or motion or changes in light or motion. Readings from the infrared sensors 308 and the optical sensors 304 may be configured to detect light or motion. The readings may be compared to verify or otherwise confirm light or motion. As a result, logic decisions regarding utilizing specified power modes or conserving power utilization may be made based on the sensors 301 as well as other internal or external sensors of the wireless earpieces 302.

In another embodiment, the wireless earpieces 302 may include chemical sensors (not shown) that perform chemical analysis of the user's skin, excretions, blood, or any number of internal or external tissues or samples. For example, the chemical sensors may determine whether the wireless earpieces 302 are being worn by the user. In one embodiment, the chemical sensors are non-invasive and may only perform chemical measurements and analysis based on the externally measured and detected factors. In other embodiments, one or more probes, vacuums, capillary action components, needles, or other micro-sampling components may be utilized. Minute amounts of blood or fluid may be analyzed to perform chemical analysis that may be reported to the user and others. The sensors 301 may include parts or components that may be periodically replaced or repaired to ensure accurate measurements. In one embodiment, the infrared sensors 308 may be a first sensor array and the optical sensors 304 may be a second sensor array.

Figure 4:
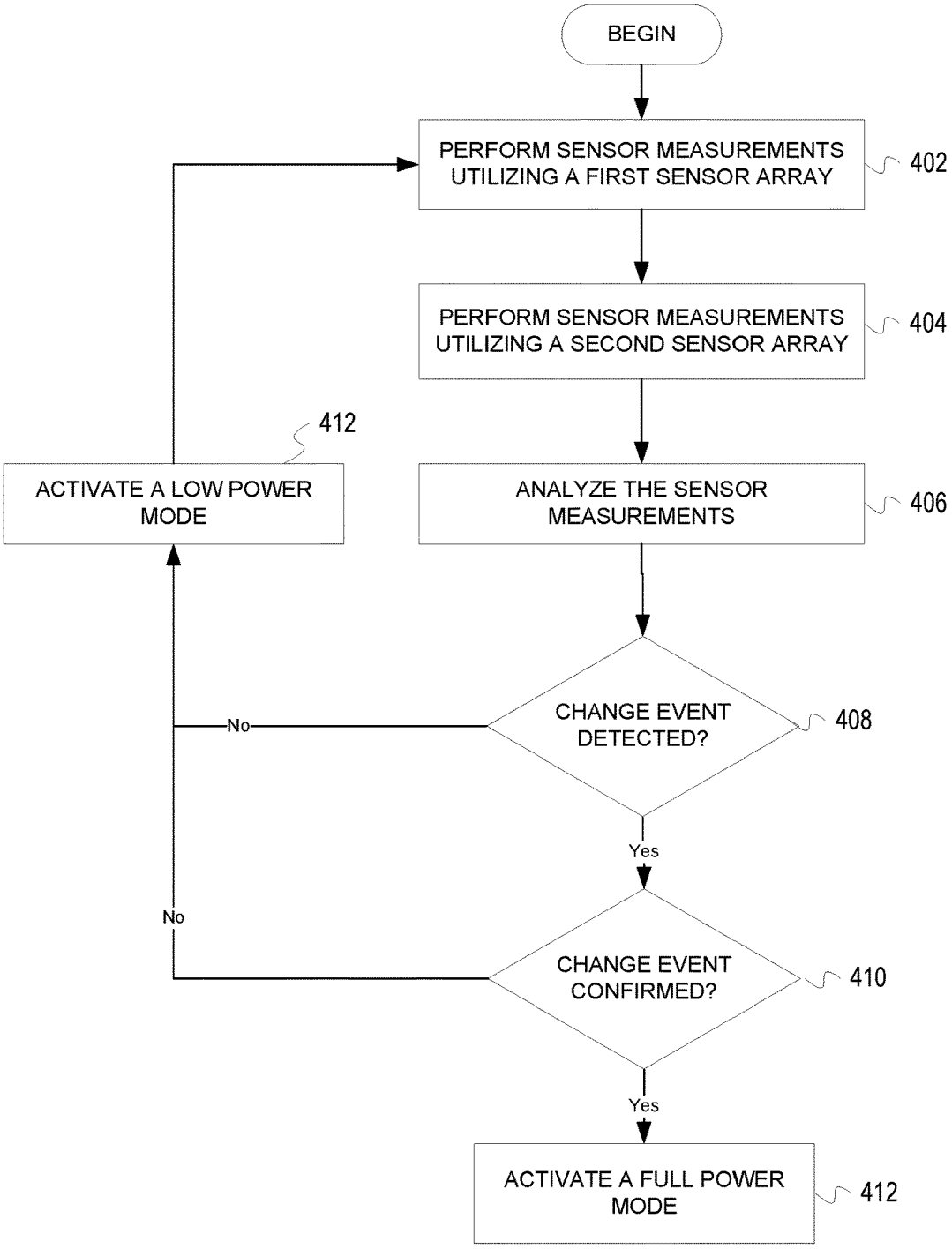
FIG. 4 is a flowchart of a process for conserving battery of wireless earpieces in accordance with an illustrative embodiment.

FIG. 4 is a flowchart of a process for determining a condition of a user utilizing wireless earpieces in accordance with an illustrative embodiment. The process of FIG. 4 may be implemented by one or more wireless earpieces, such as the wireless earpieces 102 of FIG. 1. In another embodiment, one or more steps or portions of the process of FIG. 4 may be implemented by a wireless device, computing device, wearable devices, or any number of other devices communicating directly or through a network with the wireless earpieces.

Although not specifically shown, the wireless earpieces may be linked with communications devices. The wireless earpieces may be linked with the communications device, such as a smart phone, utilizing any number of communications, standards, or protocols. For example, the wireless earpieces may be linked with a cell phone by a Bluetooth connection. The process may require that the devices be paired utilizing an identifier, such as a passcode, password, serial number, voice identifier, radio frequency, or so forth. The wireless earpieces may be linked with the communications device and any number of other devices directly or through one or more networks, such as a personal area network. The wireless earpieces may be linked so that sensor readings from the wireless device(s) may be sent to the wireless earpieces to supplement the sensor measurements and readings performed by the wireless earpieces. In addition, any number of alerts, messages, or indicators may be sent between the two devices to present information to the user.

The process of FIG. 4 may begin by performing sensor measurements utilizing a first sensor array (step 402). In one embodiment, the sensor measurements may correspond to an infrared sensor array or first optical sensors. The infrared sensor array may measure user inputs, such as a touch by a finger or gesture performed in front of the infrared sensor. The infrared sensor array may be positioned such that it is external to the body of the user when the wireless earpieces are worn by the user.

Next, the wireless earpieces perform sensor measurements utilizing a second sensor array. In one embodiment, the sensor measurements may correspond to a second set of optical sensors of the wireless earpieces. The optical sensors may detect specified wavelengths, visible light, or any number of wavelengths. The optical sensor array may be positioned, such that the sensor array is positioned proximate or against skin or tissue of the ear of the user (e.g., near or against the epithelium of the external auditory canal or auricular region of the user's ears). During steps 402 and 404, sensor measurements may include performing any number of biometric measurements. For example, metabolic, chemical, pigmentation, or other biometric readings may be taken. As noted, the optical sensors may utilize a specific wavelength(s) and the corresponding reflections to measure biometrics as well as environmental conditions. The measurements may be performed utilizing a predefined sampling rate (e.g., 1/s, 1/100 ms, 1/min, etc.). Other biometric sensors, such as mechanical (e.g., vibration, elasticity, tension, etc.) or electrical sensors, may perform additional measurements or confirm or verify the measurements. The measurements may also be triggered in response to specific detected events, such as change in the orientation or position (e.g., change from vertical to horizontal position), changes in movement or velocity, high forces (e.g., impacts, jolts, etc.), or detected events from other sensors worn by the user. The sensor measurements of steps 402 and 404 are configured to conserve battery life. For example, only a portion of the sensor arrays may be utilized. Similarly, the sensor arrays may only be powered on at specified intervals to preserve power utilized by the wireless earpieces. In one embodiment, one or more portions of the wireless earpieces may include solar cells for charging the internal battery utilizing ambient light. Internal piezo electric generators may also generate power based on the motion of the wireless earpieces.

Next, the wireless earpieces analyze the sensor measurements (step 406). The sensor measurements may be processed or otherwise evaluated by the wireless earpieces. For example, one or more processors of the wireless earpieces may process the incoming data measurements from the first and second sensor arrays. During step 406 the sensor measurements may be compared against each other. The sensor measurements may be compared to determine whether a detected event (e.g., change in light or motion) is verifiable or confirmed by more than one sensor of one or both wireless earpieces. As a result, the wireless earpieces may be configured to avoid events that are false positives thereby preserving battery life for actual utilization by the user. Additional, optical, chemical, mechanical, and/or electrical sensors of the wireless earpieces or a connected wireless device may also be utilized. The sensor measurements are processed for subsequent analysis, determinations, or decisions, implemented by the wireless earpieces.

Next, the wireless earpieces determine whether a change event is detected (step 408). The change event may be utilized to change a power state of the wireless earpieces. The change event may represent changes in light and/or motion detected by the first sensor array, second sensor array, or other sensors of the wireless earpieces or a connected wireless device. For example, changes in light and/or motion may indicate that the wireless earpieces are being picked up and that the wireless earpieces should activate all systems to be ready for user utilization. In another embodiment, the change event may be one or more conditions, factors, or parameters that are established automatically (e.g., default or factory settings) or by the user based on user input or feedback. Other sensor measurements, such as audio input, impacts, or so forth may also be utilized to detect the change event.

In response to determining the change event is detected, the wireless earpieces determine whether the change event is confirmed (step 410). The change event may be verified or confirmed during step 410 based on sensor readings from first sensor array, second sensor array or other sensors as previously noted. The change event may be detected by a single sensor array (e.g., simultaneously, concurrently, sequentially, etc.) or by multiple sensor arrays before being confirmed by secondary or other systems of the wireless earpieces or communicating wireless devices.

In response to confirming the change event during step 410, the wireless earpieces activate a full power mode (step 412). During step 412, all or a portion of the sub-system of the wireless earpieces may be powered on. For example, the full power mode may be initiated to prepare one or both of the wireless earpieces for utilization. In some embodiments, the user may specify conditions, parameters, or factors that may be utilized for the wireless earpieces to enter the full power mode. In another embodiment, only a portion of the wireless earpiece sub-systems may be activated until additional conditions have been met. For example, the transceiver may be activated for communications with the wireless earpieces until contact sensors detect that the wireless earpieces are being worn by the user for at least three seconds.

In response to determining a change event is not detected during step 408 or that the change event is not confirmed during step 410, the wireless earpieces activate a low power mode (step 412). In one embodiment, the wireless earpieces may have already been in a low power mode and thus the wireless earpieces remain in the low power mode without changes in status or the operating mode being utilized by the wireless earpieces. During the low power mode, the wireless earpieces may be operating to preserve the battery life of the wireless earpieces. For example, only a portion of the sensors and/or logic may be operating or periodically activated to perform the measurements of steps 402 and 404. In other embodiments, limited sub-systems of the wireless earpieces may be operating during the low power mode. The low power mode may also represent a sleep, hibernation, or other reduced power function of the wireless earpieces. Next, the wireless earpieces return to perform sensor measurements utilizing the first sensor array (step 402). The process of FIG. 4 may be performed in a loop to ensure that the battery life of the wireless earpieces is preserved and maintained for utilization when worn in the ears of the user.

The illustrative embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer usable program code embodied in the medium. The described embodiments may be provided as a computer program product, or software, that may include a machine-readable medium having stored thereon instructions, which may be used to program a computing system (or other electronic device(s)) to perform a process according to embodiments, whether presently described or not, since every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

Computer program code for carrying out operations of the embodiments may be written in any combination of one or more programming languages, including an object oriented programming language such as Java, Smalltalk, C++ or the like and conventional procedural programming languages, such as the "C" programming language or similar programming languages. The program code may execute entirely on a user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN), a personal area network (PAN), or a wide area network (WAN), or the connection may be made to an external computer (e.g., through the Internet using an Internet Service Provider).

Figure 5:
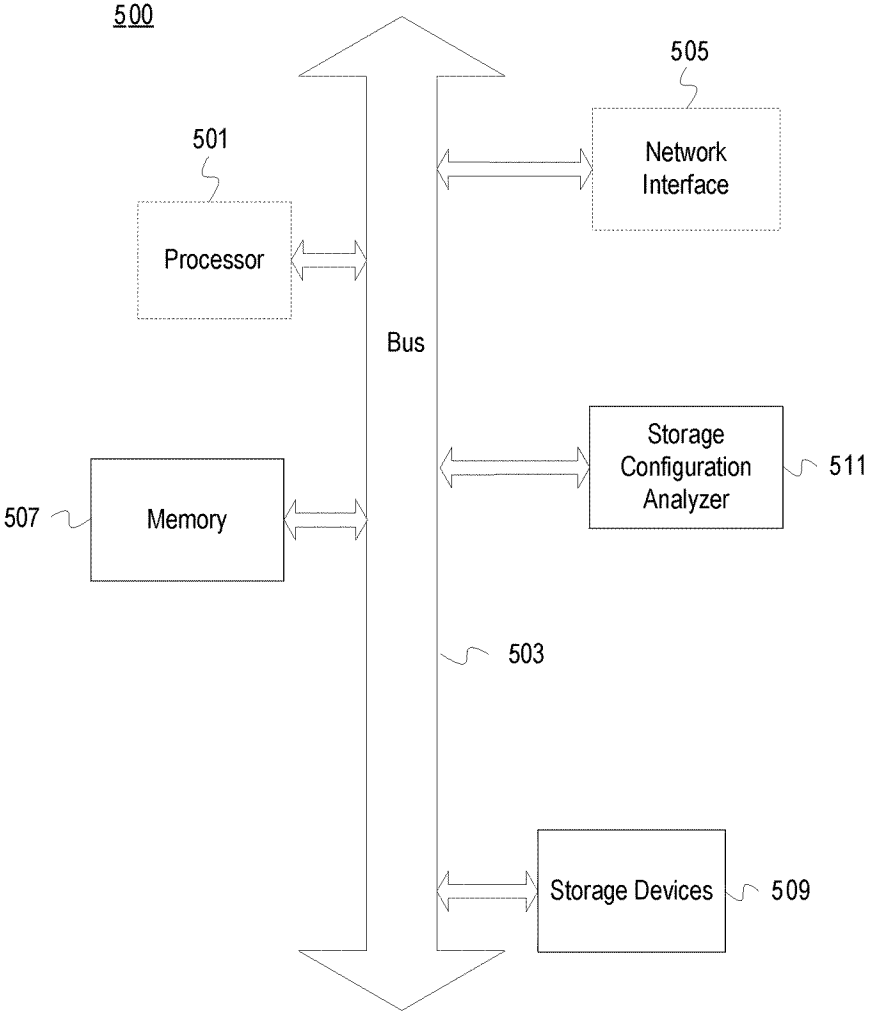
FIG. 5 depicts a computing system in accordance with an illustrative embodiment.

FIG. 5 depicts a computing system 500 in accordance with an illustrative embodiment. For example, the computing system 500 may represent a device, such as the wireless device 204 of FIG. 2. The computing system 500 includes a processor unit 501 (possibly including multiple processors, multiple cores, multiple nodes, and/or implementing multithreading, etc.). The computing system includes memory 507. The memory 507 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computing system also includes a bus 503 (e.g., PCI, ISA, PCI-Express, HyperTransport®, InfiniBand®, NuBus, etc.), a network interface 506 (e.g., an ATM interface, an Ethernet interface, a Frame Relay interface, SONET interface, wireless interface, etc.), and a storage device(s) 509 (e.g., optical storage, magnetic storage, etc.). The system memory 507 embodies functionality to implement embodiments described above. The system memory 507 may include one or more applications or sets of instructions for conserving battery utilization of wireless earpieces in communication with the computing system. Code may be implemented in any of the other devices of the computing system 500. Any one of these functionalities may be partially (or entirely) implemented in hardware and/or on the processing unit 501. For example, the functionality may be implemented with an application specific integrated circuit, in logic implemented in the processing unit 501, in a co-processor on a peripheral device or card, etc. Further, realizations may include fewer or additional components not illustrated in FIG. 5 (e.g., video cards, audio cards, additional network interfaces, peripheral devices, etc.). The processor unit 501, the storage device(s) 509, and the network interface 505 are coupled to the bus 503. Although illustrated as being coupled to the bus 503, the memory 507 may be coupled to the processor unit 501. The computing system 500 may further include any number of optical sensors, accelerometers, magnetometers, microphones, gyroscopes, temperature sensors, and so forth for verifying motion, light, or other events that may be associated with the wireless earpieces or their environment.

The features, steps, and components of the illustrative embodiments may be combined in any number of ways and are not limited specifically to those described. In particular, the illustrative embodiments contemplate numerous variations in the smart devices and communications described. The foregoing description has been presented for purposes of illustration and description. It is not intended to be an exhaustive list or limit any of the disclosure to the precise forms disclosed. It is contemplated that other alternatives or exemplary aspects are considered included in the disclosure. The description is merely examples of embodiments, processes or methods of the invention. It is understood that any other modifications, substitutions, and/or additions may be made, which are within the intended spirit and scope of the disclosure. For the foregoing, it can be seen that the disclosure accomplishes at least all of the intended objectives.

The previous detailed description is of a small number of embodiments for implementing the invention and is not intended to be limiting in scope. The following claims set forth a number of the embodiments of the invention disclosed with greater particularity.

What is claimed is:

1. A method for managing power settings utilizing a set of wireless earpieces comprising a left wireless earpiece and a right wireless earpiece, the method comprising:

performing sensor measurements utilizing at least an optical sensor of the left wireless earpiece to detect light and motion;

performing sensor measurements utilizing at least an optical sensor of the right wireless earpiece to detect light and motion;

analyzing the sensor measurements from the optical sensor of the left wireless earpiece and the optical sensor of the right wireless earpiece using a processor within the set of wireless earpieces;

determining whether a change event is detected in response to the sensor measurements using the processor within the set of wireless earpieces and if the change event is not detected activating a low power mode for the wireless earpieces;

confirming the change event is detected using the processor within the set of wireless earpieces and if the change event is not confirmed activating the low power mode for the wireless earpiece; and entering a full power mode for the wireless earpieces in response to the change event being confirmed;

wherein in the full power mode a set of functions of the set of wireless earpieces is enabled and wherein in the low power mode, a lesser set of functions is enabled in order to preserve battery life for the set of wireless earpieces.

2. The method of claim 1, further comprising:

linking the set of wireless earpieces with a communications device, wherein at least one of the left wireless earpiece and the right wireless earpiece is linked with the communications device utilizing a Bluetooth connection.

3. The method of claim 1, further comprising:

communicating an alert indicating a power status of the wireless earpieces.

4. The method of claim 1, wherein the confirming comprises: comparing the sensor measurements of the left wireless earpiece with the sensor measurements of the right wireless earpiece to confirm the change event is detected.

5. The method of claim 1, wherein the optical sensor of the left wireless earpiece is an infrared sensor array positioned exterior to a left ear of the user when worn, and wherein the optical sensor of the right wireless earpiece is an optical sensor array positioned proximate or against a right ear of the user when worn.

6. The method of claim 1, further comprising:

utilizing additional sensor measurements from sensors of the wireless earpieces to confirm the change event is detected.

7. The method of claim 6, wherein the additional sensor measurements are received from a wireless device in communication with the wireless earpieces.

8. The method of claim 1, wherein the battery is preserved utilizing the low power mode while the wireless earpieces are positioned with original packaging for the wireless earpieces.

9. A wireless earpiece, comprising:

a frame for fitting in an ear of a user;

a processor disposed within the frame for controlling functionality of the wireless earpiece;

a plurality of sensors including at least a first sensor array and a second sensor array for performing sensor measurements including optical sensors for detecting changes in light and motion;

a transceiver communicating with at least a wireless device;

wherein the processor analyzes the sensor measurements from the first sensor array and the second sensor array, determines whether a changeevent is detected in response to the sensor measurements, if the change event is detected then confirms the change event is detected based upon the first and second sensor measurements, and enters a full power mode of the wireless earpiece in response to the change event being confirmed and a low power mode if the change event is not detected or the change event is not confirmed; wherein in the full power mode a set of functions of the wireless earpiece is enabled and wherein in the low power mode, a lesser set of functions of the wireless earpiece is enabled in order to preserve battery life for the wireless earpiece.

10. The wireless earpiece of claim 9, wherein the transceiver establishes a Bluetooth link with the wireless device.

11. The wireless earpiece of claim 9, wherein the processor further communicates an alert indicating a power status of the wireless earpiece.

12. The wireless earpiece of claim 9, wherein the processor confirms the change event by comparing the sensor measurements of the first sensor array with the sensor measurements of the second sensor array.

13. The wireless earpiece of claim 12, wherein the optical sensor within the first sensor array and comprises is an infrared sensor positioned exterior to ears of the user when worn, and wherein the optical sensor within the second sensor array is positioned proximate or against the ears of the user when worn.

14. The wireless earpiece of claim 9, wherein the processor further utilizes additional sensor measurements from sensors of the wireless earpiece or the wireless device to confirm the change event is detected.

15. A set of wireless earpieces comprising:

a processor for executing a set of instructions, the processor disposed within one of a right wireless earpiece and a left wireless earpiece within the set of wireless earpieces; and a memory for storing the set of instructions disposed within one of the right wireless earpiece and the left wireless earpiece, wherein the set of instructions are executed to:

perform sensor measurements utilizing a first sensor array of the right wireless earpiece within the set of wireless earpieces to detect light and motion, at least one optical sensor within the first sensor array;

perform sensor measurements utilizing a second sensor array of the left wireless earpiece within the set of wireless earpieces to detect light and motion, at least one optical sensor within the second sensor array;

analyze the sensor measurements from the first sensor array and the second sensor array with the processor;

determine by the processor whether a change event is detected in response to the sensor measurements and if the change event is not detected to enter a low power mode;

confirm the change event is detected at the processor in response to determining a change event is detected; and enter a full power mode for the wireless earpieces in response to the change event being confirmed by the processor and if the change event is not confirmed enter the low power mode;

wherein in the full power mode a set of functions of the wireless earpiece is enabled and wherein in the low power mode, a lesser set of functions of the wireless earpiece is enabled in order to preserve battery life for the wireless earpiece.

16. The set of wireless earpieces of claim 15, wherein the set of instructions are further executed to:

link the set of wireless earpieces with a communications device, wherein at least one of the set of wireless earpieces are linked with the communications device utilizing a Bluetooth connection.

17. The set of wireless earpieces of claim 15, wherein the set of instructions are further executed to:

communicate an alert indicate a power status of the wireless earpieces.

18. The set of wireless earpieces of claim 15, wherein the set of instructions for confirming comprises:

comparing the sensor measurements of the first sensor array with the sensor measurements of the second sensor array to confirm the change event is detected.

19. The set of wireless earpieces of claim 15, wherein the set of instructions are further executed to:

utilize additional sensor measurements from sensors of the wireless earpieces or a linked wireless device to confirm the change event is detected.

* * * * *